United States Patent [19]

Ramnarace

[11] 4,094,711

[45] June 13, 1978

[54] TRACER AND COMPOSITION

[75] Inventor: Jawaharlal Ramnarace, Dana Point, Calif.

[73] Assignee: Ford Aerospace & Communications Corporation, Dearborn, Mich.

[21] Appl. No.: 829,995

[22] Filed: Sep. 1, 1977

[51] Int. Cl.[2] ..... C06B 45/36

[52] U.S. Cl. ..... 149/4; 149/6; 149/11; 149/19.3; 149/43; 149/44; 149/61; 102/87

[58] Field of Search ..... 149/4, 6, 11, 19.3, 149/43, 44, 61; 102/87

[56] References Cited

U.S. PATENT DOCUMENTS

| | | | |
|---|---|---|---|
| 3,891,482 | 6/1975 | Brown et al. | 149/19.3 X |
| 3,988,990 | 11/1976 | MacDonald et al. | 102/60 X |

*Primary Examiner*—Stephen J. Lechert, Jr.

*Attorney, Agent, or Firm*—Edmund C. Ross, Jr.; Keith L. Zerschling

[57] ABSTRACT

Improved tracer rounds and compositions therefor comprising a rubbery, particulate mixture having magnesium, polytetrafluoroethylene and advantageously other ingredients coated with copolymer of hexafluoropropylene and vinylidenefluoride, optionally containing ingredients such as carbon black, and providing advantages in preparation (e.g., lower consolidation pressures) and use (e.g., more uniform burning after ignition).

7 Claims, No Drawings

TRACER AND COMPOSITION

BACKGROUND OF THE INVENTION

Magnesium-Teflon compositions are used in a variety of tracer rounds. These dry mixtures require extremely high pressures to consolidate them into tracer cavities. Since such high consolidation pressures can deform projectiles, elaborate precautions are required to support them during loading of the tracer charge. Moreover, mixtures of magnesium and Teflon powder may not press uniformly and as a result, give erratic ignition and burn times. During temperature cycling and vibration testing, pressed magnesium-Teflon mix pulls away from the case wall and cracks causing burning down the sides and into the grain resulting in the grain being ejected before being completely burnt out in the tracer cavity. Magnesium-Teflon mixes give, however, white light and burn at a very high flame temperature.

Certain color producing tracer mixes use a dry mixture of strontium nitrate and magnesium powder which is pressed at extremely high pressures into the tracer cavity. Additives such as calcium resinate and oxamide lower the burning rate. These additives, while reducing the burn rate, considerably decrease the light and heat output of the magnesium-strontium nitrate mixture. This dry mixture also breaks up on temperature cycling and vibration tests and pulls away from the case wall resulting in erratic burning. Certain other tracer mixes use binders for better consolidation of the tracer mix. These hydrocarbon binders, however, tend to reduce the heat and light output of these tracer compositions.

Mixtures of magnesium and fluorine-containing polymers such as combinations of Teflon and Vitron A have been disclosed for use as solid propellants (see, for instance, U.S. Pat. Nos. 3,876,477 and 3,463,682) and other purposes as igniter strands (see U.S. Pat. No. 3,765,334). Other patents of interest include U.S. Pat. Nos. 3,135,201; 3,671,341; 3,732,132; 3,770,525; 3,872,192; 3,983,816 and 4,019,932.

All of the above cited patents are hereby incorporated by reference as evidencing a state of the art.

BRIEF DESCRIPTION OF THE INVENTION

This invention relates to an improved tracer round comprising a projectile with tracer cavity containing tracer composition and having in the tracer cavity a consolidated rubbery particulate tracer mixture, which mixture comprises: (A) about 30–60 parts by weight magnesium; (B) about 10–40 parts by weight polytetrafluoroethylene; and (C) about 10–25 parts by weight copolymer of hexafluoropropylene and vinylidenefluoride, wherein a coating on (A) and (B) comprises the copolymer of (C). Preferred ranges are for (A) about 40–50 parts by weight; for (B) about 10–30 parts by weight; and for (C) about 5–25 parts by weight.

DETAILED DESCRIPTION OF THE INVENTION

The compositions of this invention that are placed in cavities of projectiles of the improved tracer rounds include rubbery particulate tracer mixture commprising magnesium or other such oxidizable metal, fluorine containing homopolymer and copolymer, and, optionally other components such as igniter mix which may be pressed onto the tracer mixture. The compositions are advantageously employed in such tracer rounds as those of the 25 mm Bushmaster as well as other tracer rounds having tracer cavities therein.

In preparation of the tracer rounds and compositions therefor, rubbery particulate tracer mixture is made by coating the magnesium and polytetrafluoroethylene e.g., Teflon, a tradename and, desirably, other ingredients such as heavy Group II metal salt oxidizers (e.g., nitrates such as strontium nitrate) with rubbery fluorine-containing copolymer (preferably made from copolymerizing vinylidenefluoride and perfluoropropylene as is done to prepare Viton A (a tradename)) and is placed in the tracer cavity. The rubbery coating is preferably achieved by what is commonly referred to as "shock-gel" process, a disclosure of which appears in the paragraph bridging the columns 1 and 2 in U.S. Pat. No. 3,876,477 and in U.S. Pat. No. 3,671,341 and at column 1, lines 49–66 of U.S. Pat. No. 3,765,334, each of which is hereby herein incorporated by reference for such disclosure. Basically, such "shock-gel" process comprises dissolving the flourine-containing copolymer (e.g., Viton) in solvent as acetone, mixing fluorine-containing homopolymer (e.g., Teflon) and other desired ingredients and thereafter precipitating the mixture with a coating of the copolymer by addition of hydrocarbon (e.g., hexane). Although other procedures may be employed such as replacing the hydrocarbon addition step with a step comprising driving off solvent under vacuum and mechanically grinding the residue, the shock-gel process is preferred herein for its safety and its provision of superior free-flowing particulate products.

Igniter mixes of the tracer compositions may be prepared from ingredients as in the rubbery particulate tracer mixture described above at similar levels. The igniter mix may be pressed onto the tracer mixture in the tracer cavity and made by similar shock-gel process.

Preferred igniter mixes comprise about 50–70 parts by weight magnesium; about 5–20 parts by weight polytetrafluoroethylene; about 5–20 parts by weight copolymer of vinylidenefluoride and hexafluoropropylene; and about 1–15 parts by weight graphite.

The need for igniter mix in the tracer composition is considerably reduced if oxidizable materials such as carbon black are included in the tracer mixture, preferably at levels of 1–10, more preferably 1–5 parts by weight. The carbon black need not be included during the shock-gel process but is desirably blended afterward and employed with the metal salt oxidizer.

The rubbery characteristics of the particulate tracer mixture permits advantageously its incorporation into the tracer cavity with as little as 20,000 psi pressing to give good consolidation, although higher pressure consolidation up to 40,000 psi or more may be used. This relatively low pressure consolidation step permits elimination of need for separate loading into tracer cups by minimizing risk of deformation of the projectile during loading. Still further, the need for ring closures (metering discs), seals and crimps is minimized or eliminated in accordance with this invention.

The high heat output provided by the tracer mixture tends to reduce base drag by producing a "fumer" effect. When the metal salt oxidizer (e.g., strontium nitrate) is included, the gas output increases thereby not only still further reducing base drag but also tending to reduce burn rates.

The following examples are intended to illustrate preferred aspects and are not intended as limiting the scope of this invention. All tracer mixtures are made by shock-gel processes.

EXAMPLE 1

A tracer mix which is highly energetic and which acts as a fumer to reduce base drag has the following composition:

| White Tracer Mixture | Wt. % |
|---|---|
| Magnesium (Gran 16) | 54% |
| Teflon 7 | 30% |
| Viton A | 16% |

This white tracer mixture is pressed directly into the tracer cavity of a Bushmaster Armor Piercing Projectile. A small amount of the igniter mix set forth below is pressed on top of the tracer charge to assure reliable ignition. No ring closure, seal or crimp is used. Good ignition is obtained in gun firings and burn times of over 2½ seconds are obtained. The traces are a bright white.

| Igniter Mix | Wt. % |
|---|---|
| Magnesium (Gran 16) | 63.6% |
| Teflon 7 | 13.7 |
| Viton A | 13.7 |
| Graphite | 9.0 |

EXAMPLE 2

The following tracer mixtures are prepared and are highly energetic and act as fumers to reduce base drag:

| Red Tracer Mixture | Wt. % |
|---|---|
| Magnesium (Gran 16) | 45% |
| Teflon 7 | 23% |
| Viton A | 15% |
| Strontium Nitrate (−100/+230) | 17% |

The above mixture gives very bright, pink traces when tested in the gun firings in the Bushmaster 25mm HEI/TP cartridge. Burn times exceeding 10 seconds are obtained with a tracer cavity depth of 0.730 inches. The tracer charge is pressed in at 40,000 psi pressure. A small amount of igniter mix (from Example 1) is pressed on top of tracer charge to assure reliable ignition. However, good, reliable ignition of the above composition is obtained without the use of an ignitor mix by the addition of 3% carbon black to the above mixture as below.

| Red Tracer Mixture | Wt. % |
|---|---|
| Magnesium (Gran 16) | 45% |
| Teflon 7 | 20% |
| Viton A | 15% |
| Strontium Nitrate | 17% |
| Carbon Black | 3% |

An increase in strontium nitrate from 17% to 20% gave a brighter red color. The composition with carbon black and increased strontium nitrate which gave good ignition without igniter mix is given below:

| Red Tracer Mixture | Wt. % |
|---|---|
| Magnesium (Gran 16) | 45% |
| Teflon 7 | 20% |
| Viton A | 12% |
| Strontium Nitrate | 20% |
| Carbon Black | 3% |

This mixture ignites well and gives a very bright red trace without the use of an igniter mix when tested in the Bushmaster HEI-TP round.

It will be understood that other ingredients may be included in the tracer mixtures and composition of this invention which are conventional therefor. For example, drying aids used, for example, in the shock-gel process may be included in minor amounts as are other ingredients as ethyl cellulose.

What is claimed is:

1. An improved tracer round comprising a projectile with a cavity containing tracer compositions wherein the tracer composition comprises a consolidated rubbery particulate tracer mixture which comprises:

(A) about 30–60 parts by weight magnesium;

(B) about 10–40 parts by weight polytetrafluoroethylene; and (C) about 10–25 parts by weight copolymer of hexafluoropropylene and vinylidenefluoride, wherein a coating on (A) and (B) comprises the copolymer of (C).

2. The tracer round in accordance with claim 1, wherein the tracer composition comprises an igniter mix.

3. The tracer round in accordance with claim 2, wherein the igniter mix comprises:

(A′) about 50–70 parts by weight magnesium;

(B′) about 5–20 parts by weight polytetrafluoroethylene;

(C′) about 5–20 parts by weight copolymer of hexafluoropropylene and vinylidenefluoride; and (D′) about 1–15 parts by weight graphite.

4. The tracer round in accordance with claim 1, wherein the tracer mixture comprises:

(D) about 5–30 parts by weight metal salt oxidizer; and (E) 0–10 parts by weight oxidizable particulate carbon.

5. The tracer round in accordance with claim 4, wherein the oxidizer comprises strontium nitrate.

6. A rubbery particulate tracer mixture, which comprises:

(A) about 40–50 parts by weight magnesium;

(B) about 10–30 parts by weight polytetrafluoroethylene;

(C) about 5–25 parts by weight copolymer of hexafluoropropylene and vinylidenefluoride;

(D) about 10–25 parts by weight metal nitrate oxidizer; and (E) about 1–10 parts by weight carbon black, wherein a coating for (A), (B) and (D) comprises the copolymer of (C).

7. A method for reducing the drag on a missile moving in an oxygen containing atmosphere while providing continuous illumination of a path of the moving missile, which comprises igniting the tracer mixture of claim 6 in the tracer cavity of the moving missile.

* * * * *